US007320369B2

(12) United States Patent
Stirm et al.

(10) Patent No.: US 7,320,369 B2
(45) Date of Patent: Jan. 22, 2008

(54) VIBRATION REDUCTION APPARATUS FOR POWER TOOL AND POWER TOOL INCORPORATING SUCH APPARATUS

(75) Inventors: Michael Stirm, Oberursel (DE); Reimund Becht, Hühnfelden (DE); Norbert Hahn, Hühnstetten—Limbach (DE)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/981,197

(22) Filed: Nov. 4, 2004

(65) Prior Publication Data

US 2005/0263307 A1 Dec. 1, 2005

(30) Foreign Application Priority Data

Nov. 4, 2003 (GB) ..... 0325643

(51) Int. Cl.
*B25D 17/04* (2006.01)

(52) U.S. Cl. ..... 173/162.2; 173/162.1

(58) Field of Classification Search ..... 173/162.2, 173/162.1; 16/431
See application file for complete search history.

(56) References Cited

U.S. PATENT DOCUMENTS

| | | | | |
|---|---|---|---|---|
| 1,358,486 | A | 11/1920 | Wilhelm | |
| 3,275,089 | A | 9/1966 | Kaiser et al. | |
| 4,282,938 | A | 8/1981 | Minamidate | |
| 4,371,043 | A | 2/1983 | Kubokawa | |
| 4,401,167 | A | 8/1983 | Sekizawa et al. | |
| 4,478,293 | A * | 10/1984 | Weilenmann et al. | 173/162.2 |
| 4,611,671 | A | 9/1986 | Hansson | |
| 4,667,749 | A * | 5/1987 | Keller | 173/162.2 |
| 4,711,308 | A | 12/1987 | Blaas et al. | |
| 4,749,049 | A | 6/1988 | Greppmair | |
| 4,800,965 | A | 1/1989 | Keller | |
| 4,936,394 | A | 6/1990 | Ohtsu | |
| 5,025,870 | A | 6/1991 | Gantner | |
| 5,157,807 | A | 10/1992 | Keller et al. | |
| 5,522,466 | A | 6/1996 | Harada et al. | |
| 5,697,456 | A | 12/1997 | Radle et al. | |
| H1811 | H | 11/1999 | Rescigno | |
| 6,076,616 | A * | 6/2000 | Kramp et al. | 173/162.2 |
| 6,123,158 | A | 9/2000 | Steffen | |
| 6,148,930 | A | 11/2000 | Berger et al. | |

(Continued)

FOREIGN PATENT DOCUMENTS

DE 100 52 447 A1 5/2002

(Continued)

*Primary Examiner*—Brian D. Nash
(74) *Attorney, Agent, or Firm*—Michael P. Leary; Charles E. Yocum; Adan Ayala

(57) ABSTRACT

A power tool has a handle assembly which is biased by a torsional spring. The torsional spring has an engaging arm the position of which is fixed relative to the housing by an adjusting mechanism. The adjusting mechanism has a lever which extends outside the housing of the power tool, and a cam surface, and is mounted on and rotatable at least partially around an axle. In use, the tension in the torsional spring may be adjusted by movement of the lever. The lever is moved, causing rotation of the adjusting cam around the axle. As a result, the cam surface causes the engaging arm of the spring to be moved axially along the axle and more or less tension is applied to the torsional spring.

42 Claims, 3 Drawing Sheets

U.S. PATENT DOCUMENTS

| | | | | |
|---|---|---|---|---|
| 6,375,171 | B1 | 4/2002 | Zimmermann et al. | |
| 6,421,880 | B1 | 7/2002 | Prajapati et al. | |
| 6,446,421 | B1 | 9/2002 | Kramer et al. | |
| 6,766,868 | B2 | 7/2004 | Frauhammer et al. | |
| 6,843,327 | B2 * | 1/2005 | Meixner et al. | 173/11 |
| 6,863,479 | B2 * | 3/2005 | Frauhammer et al. | 408/241 R |
| 7,076,838 | B2 * | 7/2006 | Meixner | 16/431 |
| 7,100,706 | B2 * | 9/2006 | Meixner et al. | 173/162.2 |
| 2001/0011846 | A1 | 8/2001 | Kondorfer et al. | |
| 2002/0197939 | A1 | 12/2002 | Frauhammer et al. | |
| 2003/0006051 | A1 | 1/2003 | Schmitzer et al. | |
| 2003/0037937 | A1 * | 2/2003 | Frauhammer et al. | 173/48 |
| 2003/0132016 | A1 * | 7/2003 | Meixner et al. | 173/162.2 |
| 2004/0040729 | A1 * | 3/2004 | Meixner | 173/162.2 |
| 2005/0284646 | A1 * | 12/2005 | Bacila | 173/162.2 |

FOREIGN PATENT DOCUMENTS

| | | | | |
|---|---|---|---|---|
| DE | 10118037 | A1 | * | 10/2002 |
| EP | 0 033 304 | A1 | | 8/1981 |
| EP | 1221359 | A1 | * | 7/2002 |
| GB | 2154497 | A | * | 9/1985 |
| GB | 2 171 045 | A | | 8/1986 |
| GB | 2297514 | A | * | 8/1996 |
| GB | 2407057 | A | * | 4/2005 |

* cited by examiner

VIBRATION REDUCTION APPARATUS FOR POWER TOOL AND POWER TOOL INCORPORATING SUCH APPARATUS

FIELD OF THE INVENTION

The present invention relates to vibration reduction apparatus for power tools and to power tools incorporating such apparatus. The invention relates particularly, but not exclusively, to vibration reduction apparatus for power hammers, and to hammers incorporating such apparatus.

BACKGROUND OF THE INVENTION

Electrically driven hammers are known in which a driving member in the form of a flying mass is reciprocally driven in a piston, and impact of the flying mass against the end of the piston imparts a hammer action to a bit of the hammer. Such an arrangement is disclosed in European patent application EP1252976 and is shown in FIG. 1.

Referring in detail to FIG. 1, the prior art demolition hammer comprises an electric motor 2, a gear arrangement and a piston drive arrangement which are housed within a metal gear housing 5 surrounded by a plastic housing 4. A rear handle housing incorporating a rear handle 6 and a trigger switch arrangement 8 is fitted to the rear of the housings 4, 5. A cable (not shown) extends through a cable guide 10 and connects the motor to an external electricity supply. When the cable is connected to the electricity supply when the trigger switch arrangement 8 is depressed, the motor 2 is actuated to rotationally drive the armature of the motor. A radial fan 14 is fitted at one end of the armature and a pinion is formed at the opposite end of the armature so that when the motor is actuated the armature rotatingly drives the fan 14 and the pinion. The metal gear housing 5 is made from magnesium with steel inserts and rigidly supports the components housed within it.

The motor pinion rotatingly drives a first gear wheel of an intermediate gear arrangement which is rotatably mounted on a spindle, which spindle is mounted in an insert to the gear housing 5. The intermediate gear has a second gear wheel which rotatingly drives a drive gear. The drive gear is non-rotatably mounted on a drive spindle mounted within the gear housing 5. A crank plate 30 is non-rotatably mounted at the end of the drive spindle remote from the drive gear, the crank plate being formed with an eccentric bore for housing an eccentric crank pin 32. The crank pin 32 extends from the crank plate into a bore at the rearward end of a crank arm 34 so that the crank arm can pivot about the crank pin 32. The opposite forward end of the crank arm 34 is formed with a bore through which extends a trunnion pin 36 so that the crank arm 34 can pivot about the trunnion pin 36. The trunnion pin 36 is fitted to the rear of a piston 38 by fitting the ends of the trunnion pin 36 into receiving bores formed in a pair of opposing arms which extend to the rear of the piston 38. The piston is reciprocally mounted in cylindrical hollow spindle 40 so that it can reciprocate within the hollow spindle. An O-ring seal 41 is fitted in an annular recess formed in the periphery of the piston 38 so as to form an airtight seal between the piston 38 and the internal surface of the hollow spindle 40.

When the motor 2 is actuated, the armature pinion rotatingly drives the intermediate gear arrangement via the first gear wheel and the second gear wheel of the intermediate gear arrangement rotatingly drives the drive spindle via the drive gear. The drive spindle rotatingly drives the crank plate 30 and the crank arm arrangement comprising the crank pin 32, the crank arm 34 and the trunnion pin 36 converts the rotational drive from the crank plate 30 to a reciprocating drive to the piston 38. In this way the piston 38 is reciprocatingly driven back and forth along the hollow spindle 40 when the motor is actuated by a user depressing the trigger switch 8.

The spindle 40 is mounted in magnesium casing 42 from the forward end until an annular rearward facing shoulder (not shown) on the exterior of the spindle butts up against a forward facing annular shoulder (not shown) formed from a set of ribs 7 in the interior of the magnesium casing 42. The ribs enable air in the chamber surrounding the spindle 40 to circulate freely in the region between a ram 58 and a beat piece 64. An increased diameter portion on the exterior of the spindle fits closely within a reduced diameter portion on the interior of the magnesium casing 42. Rearwardly of the increased diameter portion and the reduced diameter portion an annular chamber is formed between the external surface of the spindle 40 and the internal surface of the magnesium casing 42. This chamber is open at its forward and rearward ends. At its forward end the chamber communicates via the spaces between the ribs in the magnesium casing with a volume of air between the ram 58 and the beat piece 64. At its rearward end the chamber communicates via the spaces between the ribs 7 and the recess of the gear casing 5 with a volume of air in the gear casing 5.

The volume of air in the gear casing 5 communicates with the air outside of the hammer via a narrow channel 9 and a filter 11. The air pressure within the hammer, which changes due to changes in the temperature of the hammer, is thus equalised with the air pressure outside of the hammer. The filter 11 also keeps the air within the hammer gear casing 5 relatively clean and dust free.

The ram 58 is located within the hollow spindle 40 forwardly of the piston 38 so that it can also reciprocate within the hollow spindle 40. An O-ring seal 60 is located in a recess formed around the periphery of the ram 58 so as to form an airtight seal between the ram 58 and the spindle 40. In the operating position of the ram 58 (shown in the upper half of FIG. 1), with the ram located behind bores 62 in the spindle, a closed air cushion is formed between the forward face of the piston 38 and the rearward face of the ram 58. Reciprocation of the piston 38 thus reciprocatingly drives the ram 58 via the closed air cushion. When the hammer enters idle mode (i.e. when the hammer bit is removed from a work piece), the ram 58 moves forwardly, past the bores 62 to the position shown in the bottom half of FIG. 1. This vents the air cushion and so the ram 58 is no longer reciprocatingly driven by the piston 38 in idle mode, as is known to persons skilled in the art.

Known hammer drills of this type suffer from the drawback that the hammer action generates significant vibrations, which can be harmful to users of the apparatus, and can cause damage to the apparatus itself.

Solutions to this problem have been proposed, for example, by including in devices of the type shown in FIG. 1 compression springs between either end of handle 6 and the body of the device. However, such springs can cause the handle 6 to experience a rocking motion which results from the spring at one end of handle 6 being compressed whilst the spring at the other end is extended. This is then followed by the previously compressed spring extending whilst the previously extended spring becomes compressed. This rocking motion of the handle is extremely uncomfortable and can be dangerous to the user of the power tool. In particular, the rocking motion is then damped by flexing of the user's wrist, and such repeated flexing sustained by regular long-term use of the power tool could lead to a number of debilitating disorders.

An alternative solution to the above problem is described in European patent application EP0033304 and is shown in FIG. 2. Referring to FIG. 2, the prior art demolition hammer has a pair of handles 102 which are connected to axle 105 by first arms 113. Axle 105 is fixed to housing 101 but is able to rotate relative thereto. Second arms 106 are connected at one end to axle 105 and at the other to compression springs 111, which are themselves connected at their other end to housing 101. As a result, any rotation of axle 105 causes the compression or extension of springs 111. Therefore, any movement of one of handles 102 is transferred down one first arm 113 via axle 105 and along the other first arm 113 to the other handle 102 whilst being damped by springs 111. However, because handles 102 move through an arc there remains a twisting element to the motion of handles 102 as a result of which the device described in EP0033304 cannot easily be adapted to devices of the type shown in FIG. 1.

Another problem with devices of the prior art is that the vibration damping devices are large, requiring additional space within the housing of the power tool, and the additional components add weight to the tool, which is also undesirable.

A further problem associated with the prior art is that under different circumstances different spring tensions produce more effective damping of vibrations. It is therefore known to produce power tools having adjustable spring tensioning means, such as that described in EP0033304. However, such devices typically require the housing of the tool to be removed in order to access the tension adjusting means. Furthermore, once access has been established it is also typical to require a specific tool to make the tension adjustment. As a result the tension is rarely adjusted and the full benefit of the vibration damping apparatus is not utilised.

Preferred embodiments of the present invention seek to overcome the above-described disadvantages of the prior art.

BRIEF SUMMARY OF THE INVENTION

According to an aspect of the present invention there is provided a handle assembly for a power tool, the assembly comprising:

handle means adapted to be held by a user of the power tool and to be mounted to a housing of the power tool such that the handle means is capable of movement relative to the housing;

biasing means for urging said handle means towards a first handle position relative to said housing; and adjustment means for adjusting the biasing force of said biasing means, wherein said adjustment means comprises at least one cam adapted to rotate about a respective first axis to move and fix a portion of said biasing means relative to said housing.

By providing means for adjusting the biasing force of the biasing means, the advantage is provided that the user is able to select a biasing force in the biasing means which provides a damping effect of the handle which best suits the circumstances in which the tool is being used. Furthermore, by providing a cam which operates in the manner described above, this provides the advantage that the cam can be operated by a lever extending outside the housing of the power tool which is rotated to alter the tension in the spring. As a result, it is not necessary to gain access within the housing of the tool to alter the tension of the spring, nor is it necessary to use a specific tool.

In a preferred embodiment, rotation of at least one said cam about the corresponding said first axis causes movement of a portion of said biasing means in a direction substantially parallel to the axis of rotation of the cam.

By providing the adjusting means such that the rotation of the cam results in movement of the biasing means in a direction which is substantially parallel to axis of rotation of the cam, the advantage is provided that a large movement of the lever can result in a small movement of the portion of the biasing means which is engaged by the cam. This therefore allows for considerable sensitivity in the adjustment in the tension of the biasing means.

The assembly may further comprise axle means adapted to be attached to the housing and to be rotated about a second axis relative to the housing between a first axle position and a second axle position;

at least one arm adapted to pivot with said axle means; and a plurality of connectors connected between said handle means and at least one said arm for converting rotational movement of the or each arm into substantially linear movement of said handle means.

By attaching the handle means of a power tool to axle means via at least one arm and connectors, the advantage is provided that vibrations in the handle are damped more effectively than in the prior art. Furthermore, the vibrations are damped without conversion into vibrations in a different direction. In particular, when vibrations cause the movement of one end of the handle, the axle means, in combination with the or each arm and connectors, transfers some of that vibration to the other end of the handle means whilst the biasing means damps the vibration. As a result, the rocking motion of the handle means, as experienced in the prior art, where the spring at one end of the handle means is able to be compressed whilst the spring at the other end of the handle can be extended, is reduced. Consequently, the uncomfortable and potentially damaging flexing of the wrist is similarly reduced. Furthermore, because of the linkage of arms and connectors with the handle means, the further advantage is provided that the handle means is not caused to twist in the hand of the user. Thus the reduction or removal of one form of vibration does not introduce an alternative undesirable vibration. This combination of advantages provides a significantly and surprisingly improved reduction in the vibrations of this type of apparatus compared to that experienced in the prior art.

The assembly may further comprise guide means adapted to be connected to said housing and to have said connectors slidably mounted therein.

By providing guide means within which the connectors are slidably mounted, the advantage is provided that any non-linear movement of the handle means relative to the housing, such as rattling, is further reduced.

In a preferred embodiment the second axis is substantially parallel to a major dimension of the handle means.

In a preferred embodiment the handle means comprises a handle, at least one first said connector is attached adjacent a first end of said handle and at least one second said connector is attached adjacent a second end of said handle.

The biasing means may comprise at least one helical spring.

The biasing means may comprise at least one leaf spring.

The biasing means may comprise torsional biasing means.

By using a torsional biasing means to urge the axle means towards the first position, the advantage is provided that the biasing means can be of particularly compact construction since it can extend around or within the axle means. This results in a significant reduction in the space required within the housing to provide effective damping. Furthermore the torsional biasing means does not add significantly to the weight of the device and is surprisingly effective, for its weight, in vibration reduction when compared to devices of the prior art.

In a preferred embodiment, said axle means comprises at least one hollow portion and said torsional biasing means is at least partially located therein.

By locating the torsional biasing means within a hollow portion of the axle means, this provides the advantage that the combined volume required for the axle means and biasing means can be significantly reduced.

According to another aspect of the present invention, there is provided a power tool comprising:

a housing;

a motor in the housing for actuating a working member of the tool; and a handle assembly as defined above.

BRIEF DESCRIPTION OF THE DRAWINGS

Preferred embodiments of the present invention will now be described, by way of example only and not in any limitative sense, with reference to the accompanying drawings, in which.

DETAILED DESCRIPTION OF THE INVENTION

Figure 1:
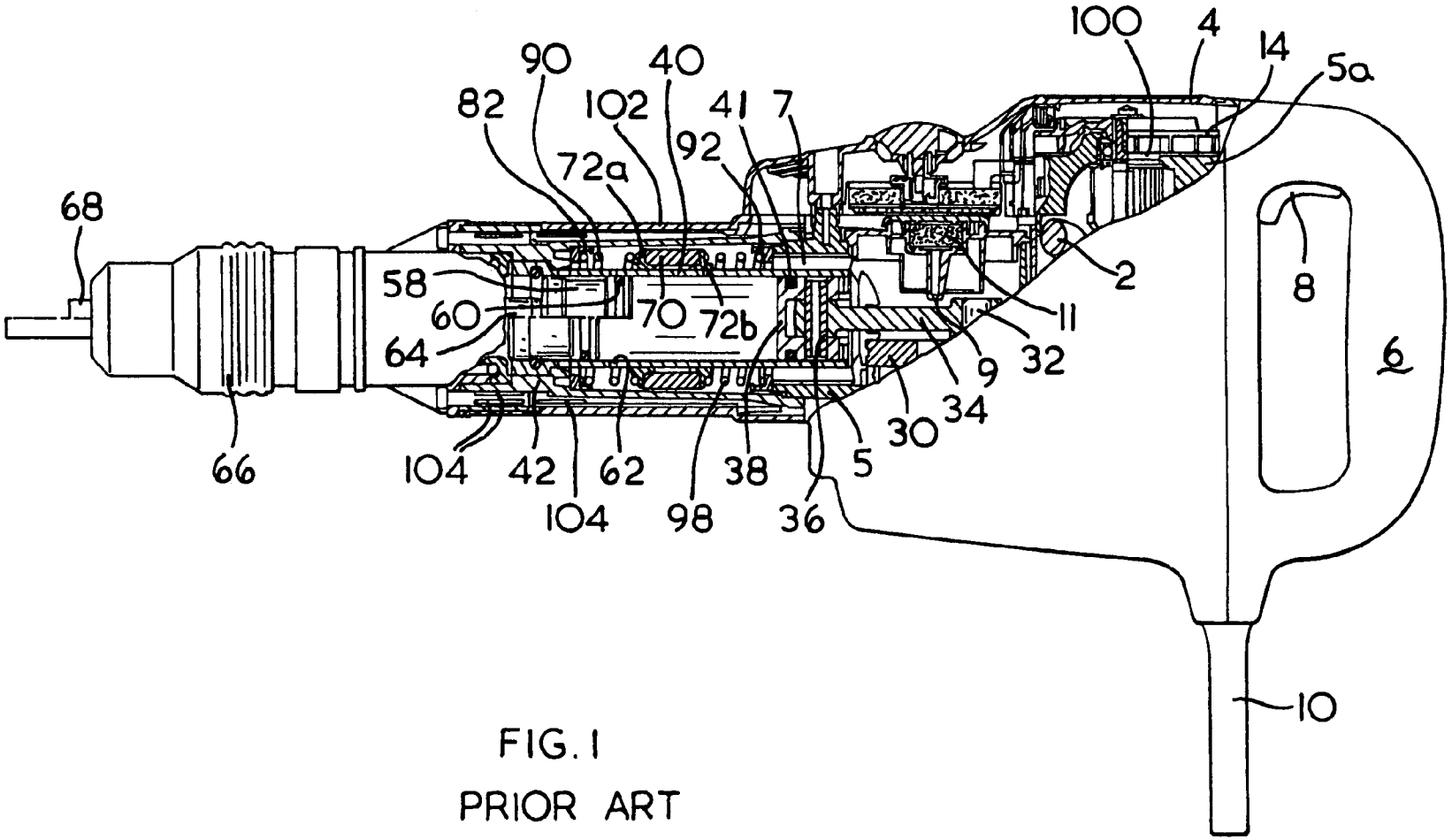
FIG. 1 PRIOR ART
FIG. 1 is a partially cut away side view of a first prior art demolition hammer.
Figure 2:
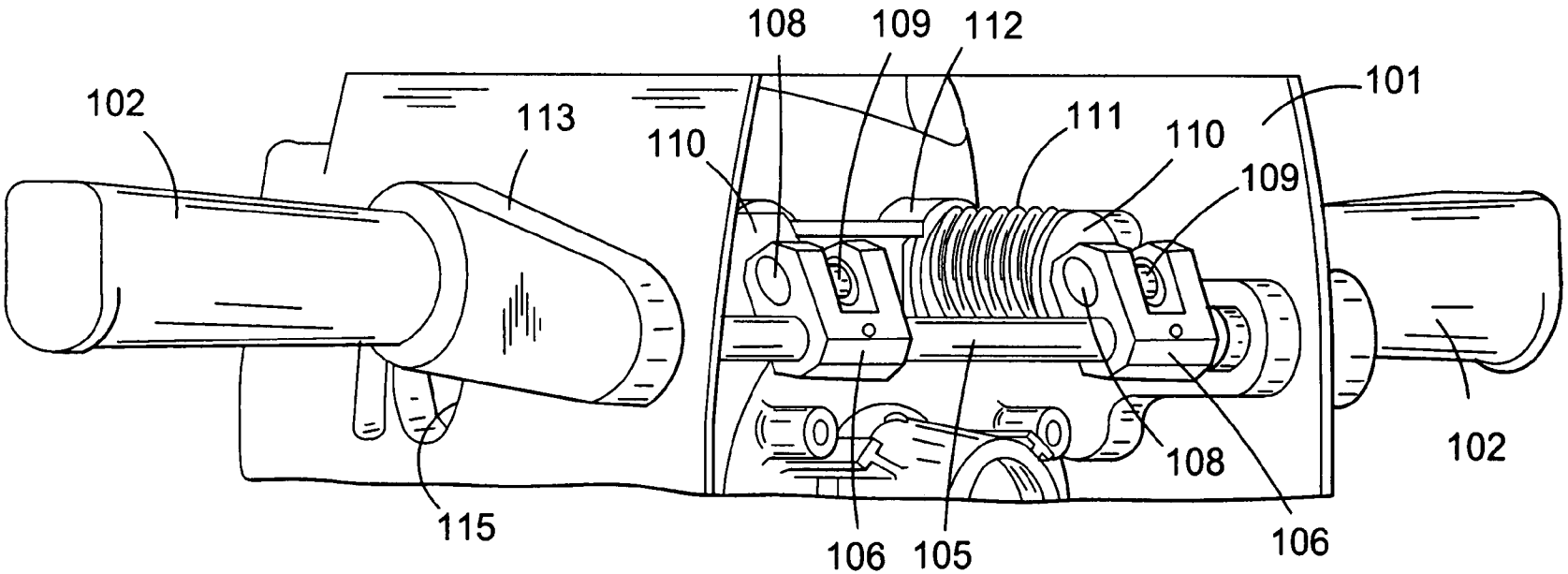
FIG.2 PRIOR ART
FIG. 2 is a perspective view of a handle assembly of a second prior art demolition hammer.
Figure 3:
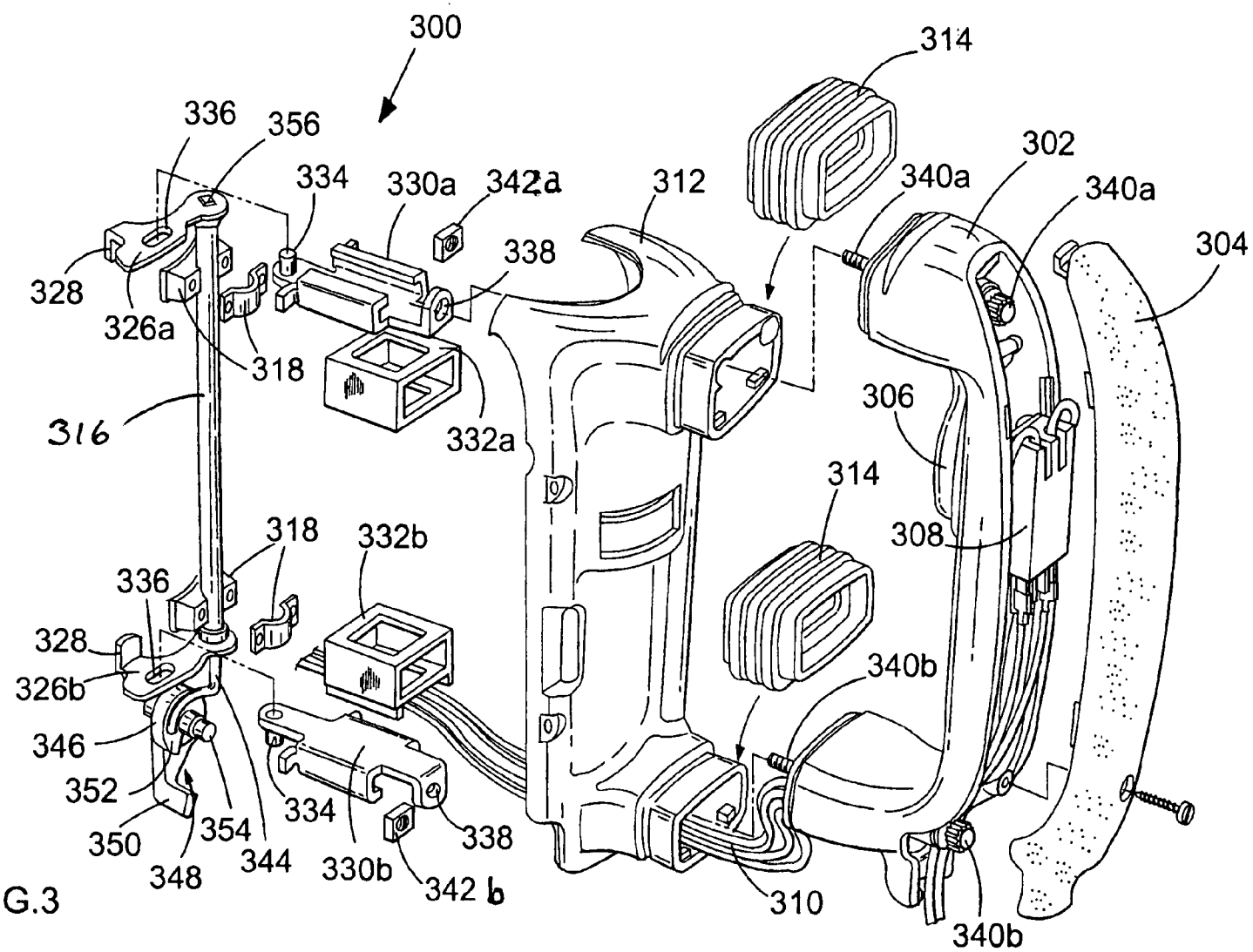
FIG. 3 is an exploded perspective view of a handle assembly embodying the present invention.

Referring to FIG. 3, a handle assembly 300 for use as part of a power hammer (not shown) has a handle 302 which has a rubberised gripping portion 304. Handle 302 also has a trigger 306 which activates switch 308 and provides power to the hammer mechanism via cables 310. Handle 302 is mounted to the housing 312 of the power tool, only a portion of which is shown in FIG. 3, and handle 302 is capable of limited movement relative to housing 312. Rubberised sleeves 314 cover the joint between handle 302 and housing 312.

The handle assembly also has a hollow axle 316 which is attached to the housing 312 by brackets 318 and is able to rotate relative to the housing 312 between a first position and a second position. Axle 316 is biased towards said first position by biasing means in the form of a torsional spring 344. Torsional spring 344 extends within hollow axle 316 and is fixed at one end relative to housing 312 by engaging portion 346 which engages adjusting means 348 but is able to rotate, at that end, relative to andwithin hollow axle 316. The other end of torsional spring 344 (a portion of which can be seen at 356) is able to rotate relative to the housing 312 but is fixed relative to axle 316. Thus torsional spring 344 biases axle 316 towards a first position.

Arms 326*a* and 326*b* are fixed relative to axle 316 such that rotation of axle 316 causes rotation of arms 326*a* and 326*b*. Stops 328 engage respective portions (not shown) of the housing 312, thereby preventing movement of arms 326*a* and 326*b* beyond a predetermined position. The handle assembly 300 also has connectors 330*a* and 330*b* which are slidably mounted within guides 332*a* and 332*b* respectively, which are themselves fixed relative to housing 312. Connectors 330*a* and 330*b* each have a respective pin 334 at one end which extends into respective aperture 336 in arms 326*a* and 326*b*. At the other end of each connector 330*a* and 330*b* apertures 338 receive bolts 340*a* and 340*b* respectively and the connectors 330*a* and 330*b* are fixed to the handle 302 by means of respective nuts 342*a* and 342*b*. Bolts 340*a* and 340*b* extend into and are fixed relative to handle 302.

The assembly 300 is also provided with means for adjusting the tension in torsional spring 344. Adjusting means 348 has a lever 350 which extends outside the housing of the power tool to enable it to be actuated by a user of the tool. It also has a cam surface 352 and is mounted on and rotatable at least partially around an axle 354.

In use, if vibrations in the body of the power tool, such as a hammer, to which handle assembly 300 is connected cause movement of one end, for example the upper end as shown in FIG. 3, of handle 302 relative to housing 312, movement of handle 302 causes movement of connector 330*a* since it is fixed relative to handle 302 by bolt 340*a* which extends through hole 338 and is fixed by nut 342. Movement of connector 330*a* in turn causes movement of arm 326*a*, which is damped by torsional spring 344. At the same time, movement of arm 326*a* results in rotation of axle 316 which therefore causes movement of the other arm 326*b*. As a result, movement of one arm 326*a* automatically causes the movement of the other arm 326*b*. Movement of arm 326*b* in turn causes connector 330*b* to slide within guide means 332*b* and by virtue of the fixed connection between connector 330*b* and bolt 340*b*, the lower end of handle 302 is caused to move relative to housing 312.

As a result, it can be seen that movement of one end of handle 302 will result in an equivalent movement of the other end of handle 302. Thus the tendency for the opposing ends of handle 302 to pivot about an axis transverse to the longitudinal axis of the handle 302, and the resultant dangerous flexing of the wrist, is reduced. The use of connectors 330*a* and 330*b* further ensures that the movement of handle 302 does not rotate along its length as a result of the movement of arms 326*a* and 326*b*.

The tension in torsional spring 344 may be adjusted by movement of adjusting means 348. Lever 350 is moved, causing rotation of adjusting means 348 around axle 354. As a result of this rotation, cam surface 352 causes arm portion 346 of spring 344 to be moved axially along axle 354, and more or less tension is applied to torsional spring 344, depending on the position of lever 350.

It will be appreciated by persons skilled in the art that the above embodiment has been described by way of example only, and not in any limitative sense, and that various alterations and modifications are possible without departure from the scope of the invention as defined by the appended claims. For example, the biasing means may alternatively or additionally include helical springs or leaf springs.

The invention claimed is:

1. A handle assembly for a power tool, the assembly comprising:

a handle adapted to be held by a user of the power tool and to be mounted to a housing of the power tool such that the handle is capable of movement relative to the housing;

biasing means for urging said handle towards a first handle position relative to said housing; and adjustment means for adjusting the biasing force of said biasing means, wherein said adjustment means comprises at least one cam adapted to rotate about a respective first axis and rotation of the at least one cam about the first axis causes movement of a portion of the biasing means in a direction substantially parallel to the first axis to move and fix a portion of said biasing means relative to said housing.

2. An assembly according to claim 1, further comprising:

an axle adapted to be attached to the housing and to be rotated about a second axis relative to the housing between a first axle position and a second axle position;

at least one arm adapted to pivot with said axle; and a plurality of connectors connected between said handle and at least one said arm for converting rotational movement of the arm into substantially linear movement of said handle.

3. An assembly according to claim 2, further comprising guide means adapted to be connected to said housing and to have said connectors slidably mounted therein.

4. An assembly according to claim 2, wherein said second axis is substantially parallel to a major dimension of the handle.

5. An assembly according to claim 2, wherein a first said connector is attached adjacent a first end of said handle and a second said connector is attached adjacent a second end of said handle.

6. An assembly according to claim 2, wherein the biasing means comprises torsional biasing means and said axle comprises a hollow portion and said torsional biasing means is at least partially located in the hollow portion.

7. An assembly according to claim 1, wherein the biasing means comprises at least one helical spring.

8. An assembly according to claim 1, wherein the biasing means comprises at least one leaf spring.

9. An assembly according to claim 1, wherein the biasing means comprises torsional biasing means.

10. A power tool comprising:

a housing;

a motor in the housing for actuating a working member of the tool; and a handle assembly including:

a handle adapted to be held by a user of the power tool and to be mounted to a housing of the power tool such that the handle is capable of movement relative to the housing;

biasing means for urging said handle towards a first handle position relative to said housing; and adjustment means for adjusting the biasing force of said biasing means, wherein said adjustment means comprises at least one cam adapted to rotate about a respective first axis and rotation of the at least one cam about the first axis causes movement of a portion of the biasing means in a direction substantially parallel to the first axis to move and fix a portion of said biasing means relative to said housing.

11. A power tool according to claim 10, further comprising:

an axle adapted to be attached to the housing and to be rotated about a second axis relative to the housing between a first axle position and a second axle position;

at least one arm adapted to pivot with said axle; and a plurality of connectors connected between said handle and at least one said arm for converting rotational movement of the arm into substantially linear movement of said handle.

12. A power tool according to claim 11, further comprising guide means adapted to be connected to said housing and to have said connectors slidably mounted therein.

13. A power tool according to claim 11, wherein said second axis is substantially parallel to a major dimension of the handle.

14. A power tool according to claim 11, wherein a first said connector is attached adjacent a first end of said handle and a second said connector is attached adjacent a second end of said handle.

15. A power tool according to claim 10, wherein the biasing means comprises at least one helical spring.

16. A power tool according to claim 10, wherein the biasing means comprises at least one leaf spring.

17. A power tool according to claim 10, wherein the biasing means comprises torsional biasing means.

18. A handle assembly for a power tool, the assembly comprising:

a handle adapted to be held by a user of the power tool and to be mounted to a housing of the power tool such mat the handle is capable of movement relative to the housing between a first position and a second position;

a spring exerting an operator adjustable biasing force;

a cam for adjusting the biasing force, the cam rotatable about a the first axis to move a porrion of said spring in a direction substantially parallel to first axis; and wherein the spring urges the handle towards the first position.

19. A handle assembly according to claim 18, further comprising:

an axle rotatably mounted to the housing and rotatable about a second axis between a first axle position and a second axle position;

an arm adapted to pivot with said axle; and a connector connected between said handle and said arm for converting rotational movement of the arm into substantially linear movement of said handle.

20. A handle assembly according to claim 19, further comprising a guide fixedly connected to said housing and adapted to have the connector slidably mounted thereto.

21. A handle assembly according to claim 19. wherein the second axis is substantially parallel to a hand grip portion of the handle.

22. A handle assembly according to claim 18, wherein the spring comprises a helical spring.

23. A handle assembly according to claim 18, wherein the spring comprises a leaf spring.

24. A handle assembly according to claim 18, wherein the spring comprises a torsion spring.

25. A handle assembly according to claim 19, wherein the spring comprises a torsion spring, and the axle defines a bore, and the torsion spring is at least partially located in the bore.

26. A power tool comprising:

a housing;

a working member;

a motor in the housing for actuating the working member of the tool; and a handle assembly including:

a handle adapted to be held by a user of the power tool and to be mounted to a housing of the power tool such that the handle is capable of movement relative to the housing between a first position and a second position;

a spring exerting an operator adjustable biasing force;

a cam for adjusting the biasing force, the cam rotatable about a first axis to move a portion of said spring in a direction substantially parallel to the first axis; and wherein the spring urges the handle towards the first position.

27. A power tool according to claim 26, further comprising:

an axle rotatably attached to the housing and rotatable about a second axis between a first axle position and a second axle position;

an arm adapted to pivot with the axle; and a connector connected between the handle and the arm for converting rotational movement of the arm into substantially linear movement of the handle.

28. A power tool according to claim 27, further comprising a guide fixedly connected to said housing and adapted to have the connector slidably mounted thereto.

29. A power tool according to claim 27, wherein the second axis is substantially parallel to a hand grip portion of the handle.

30. A power tool according to claim 27, wherein the spring comprises a torsion spring, and the axle defines a bore, and the torsion spring is at least partially located in the bore.

31. A power tool according to claim 26, wherein the spring comprises a helical spring.

32. A power tool according to claim 26, wherein the spring comprises a leaf spring.

33. A power tool according to claim 26, wherein the spring comprises a torsion spring.

34. A power tool comprising:

a housing having a front end and a rear end;

a working member proximate to the front end of the housing;

a motor in the housing for driving the working member of the tool; and a substantially C shaped handle adapted to be held by a user of the power tool, the handle having a first end and a second end and a hand grip portion between the first end and the second end, the handle movable relative to the housing;

a connector assembly connected between the handle and the housing, and adapted for guiding movement of the handle relative to the housing;

an axle rotatably attached to the housing and extending along an axis between a first end of the axle and a second end of the axel, the axis substantially parallel to the hand grip portion;

a first arm fixed to the axle proximate to the first end and a second ann fixed to the axle proximate to the second end; the first arm linked to the first end of the handle via the connector assembly and the second ann linked to the second end of the handle via the connector assembly;

a spring connected between the housing and the axle so as to urge the axle between a first pivot position and a second pivot position and thereby urge the handle to a second position relative to the housing;

an adjustment mechanism for permitting a tool user to selectively adjust a biasing force exerted by the spring.

35. A power tool according to claim 34 wherein the axle is a hollow axle, and the biasing spring is a torsion spring at least partially located inside the axle with a first spring end fixed to the axle and a second spring end connected to the adjustment mechanism.

36. A power tool according to claim 35 wherein the adjustment mechanism includes a earn mounted to the housing, and the cam includes a cam surface connected to the second spring end so that rotation of the cam acts to one of increase and decrease the torsion in the torsion spring.

37. A power tool according to claim 36 wherein the adjustment mechanism further includes an external operator connected to the cam and manipulatable by the tool user.

38. A power tool according to claim 37 wherein the external operator is a lever.

39. A power tool according to claim 36 wherein the cam includes a cam axis perpendicular to the axle axis.

40. A power tool according to claim 34 wherein the connector assembly includes a first connector subassembly between the first arm and the first end of the handle and a second connector subassembly between the second arm and the second end of the handle.

41. A power tool according to claim 40 wherein the first connector subassembly includes:

a guide fixed to the housing;

a connector slidably mounted to the guide and arranged between the first arm and the first end of the handle so that substantially linear movement of the handle is translated into rotation of the axle.

42. A power tool according to claim 41 wherein the connector has a first connector end pivotably connected to the first ann and a second connector end connected to the first end of the handle.

* * * * *

UNITED STATES PATENT AND TRADEMARK OFFICE

CERTIFICATE OF CORRECTION

PATENT NO. : 7,320,369 B2
APPLICATION NO. : 10/981197
DATED : January 22, 2008
INVENTOR(S) : Michael Stirm, Reimund Becht and Norbert Hahn It is certified that error appears in the above-identified patent and that said Letters Patent is hereby corrected as shown below:

Title page, (56) References Cited:

Column 2, Item [56] FOREIGN PATENT DOCUMENTS:

| | | | |
|---|---|---|---|
| Insert: | DE | 100 36 078 A1 | 2/2002 |
| | DE | 41 24 574 A1 | 1/1993 |

Signed and Sealed this

Eighth Day of July, 2008

JON W. DUDAS
*Director of the United States Patent and Trademark Office*